US011912447B2

(12) United States Patent
Cutler et al.

(10) Patent No.: US 11,912,447 B2
(45) Date of Patent: Feb. 27, 2024

(54) AUTOMATIC SYRINGE HANDLING SYSTEM

(71) Applicants: University of South Carolina, Columbia, SC (US); Nephron Pharmaceuticals Corporation, West Columbia, SC (US)

(72) Inventors: John Michael Cutler, West Columbia, SC (US); John Perry Diamond, Cayce, SC (US); Ramy Harik, Lexington, SC (US); William Sickinger, Jr., Simsbury, CT (US); Jon Alan Burgess, Cayce, SC (US); Luther Joey Vann, Jr., Columbia, SC (US); Charles Gainey, Jr., Lexington, SC (US)

(73) Assignees: University of South Carolina, Columbia, SC (US); Nephron Pha, West Columbia, SC (US)

( * ) Notice: Subject to any disclaimer, the term of this patent is extended or adjusted under 35 U.S.C. 154(b) by 0 days.

(21) Appl. No.: 17/771,519

(22) PCT Filed: Oct. 23, 2020

(86) PCT No.: PCT/US2020/056978

§ 371 (c)(1),
(2) Date: Apr. 25, 2022

(87) PCT Pub. No.: WO2021/081275

PCT Pub. Date: Apr. 29, 2021

(65) Prior Publication Data

US 2022/0371756 A1 Nov. 24, 2022

Related U.S. Application Data

(60) Provisional application No. 62/925,895, filed on Oct. 25, 2019.

(51) Int. Cl.
*B65B 3/00* (2006.01)
*B65B 7/28* (2006.01)

(52) U.S. Cl.
CPC ..... *B65B 3/003* (2013.01); *B65B 7/2821* (2013.01)

(58) Field of Classification Search
CPC ..... B65B 3/003; B65B 7/2821
See application file for complete search history.

(56) References Cited

U.S. PATENT DOCUMENTS 5,884,457 A * 3/1999 Ortiz ..... B65B 7/2835 53/492
6,915,619 B2 * 7/2005 Baldwin ..... B65B 9/02 53/399

(Continued)

FOREIGN PATENT DOCUMENTS

CN 108974410 12/2018
CN 108974410 A * 12/2018

(Continued)

*Primary Examiner* — Timothy L Maust
(74) *Attorney, Agent, or Firm* — Burr & Forman LLP; Douglas L. Lineberry

(57) ABSTRACT

An automated syringe handling system that will safely, securely, and quickly assemble syringes or other medical devices under controlled/sterile conditions while maintaining the syringes in a stable orientation and eliminating unnecessary operator contact with the syringes and working area.

15 Claims, 21 Drawing Sheets

(56) References Cited

U.S. PATENT DOCUMENTS

| | | | | |
|---|---|---|---|---|
| 6,986,234 | B2 * | 1/2006 | Liedtke | B65B 15/04 53/399 |
| 8,807,177 | B2 * | 8/2014 | Strangis | B63C 9/0005 604/416 |
| 9,033,006 | B2 * | 5/2015 | Perazzo | B65B 7/28 141/319 |
| 9,466,088 | B2 * | 10/2016 | Perazzo | G16H 20/17 |
| 10,384,006 | B2 * | 8/2019 | Perazzo | B67B 7/182 |
| 2013/0174520 | A1 | 7/2013 | Tessier et al. | |
| 2015/0210410 | A1 * | 7/2015 | Umeno | A61J 1/2096 53/51 |
| 2018/0105294 | A1 * | 4/2018 | Abboud | B65B 3/003 |

FOREIGN PATENT DOCUMENTS

| | | | |
|---|---|---|---|
| JP | 10273217 | A * | 10/1998 |
| WO | WO2014138607 | | 9/2014 |

* cited by examiner

AUTOMATIC SYRINGE HANDLING SYSTEM

BACKGROUND

1) Technical Field

The subject matter disclosed herein is generally directed to an automated syringe handling system that will safely, securely, and quickly assemble syringes or other medical devices under controlled/sterile conditions while maintaining the syringes in a stable orientation and eliminating unnecessary operator contact with the syringes and working area.

2) Related Art

Automated, fast and sterile are the key industry demands for assembling medical or other components that will ultimately be used in a medical or other sensitive environment. Accordingly, it is an object of the present disclosure to provide an automated syringe handling system that will safely, securely, and quickly assemble syringes or other medical devices under controlled/sterile conditions.

3) Summary

The above objectives are accomplished according to the present disclosure by providing an automatic syringe filling station. The station may include a syringe magazine that has an inclined slope, at least one syringe cam that has a cam finger and a cam blocking guard, a gripper assembly for removing at least one syringe from the syringe cam, a filling block for injecting liquid into the at least one syringe, and a cap array. Further, the inclined slope may be substantially 10 degrees. Again, the at least one syringe cam may pneumatically powered. Still, the syringe is oriented within the syringe magazine and at least one syringe cam with the Luer lock of the syringe oriented downward. Moreover, the syringe cam may be biased to return to engage another syringe contained in the syringe magazine. Further yet, the cam blocking guard prevents release of another syringe as the first syringe is moved. Still yet, the gripper assembly may be disassembled to replace portions of the gripper assembly. Yet again, the cap array may include voids that engage a syringe cap for the syringe. Again further, the filling block may have at least one face of the filling block aerodynamically shaped to improve air flow.

In a further embodiment, a method is provided for automatically filling a syringe. The method may include loading at least one syringe into at least one syringe magazine that has an inclined slope, having a cam finger supported on a syringe cam that receives a syringe from the syringe magazine, moving the syringe cam such that the syringe moves from a syringe rail exit while a syringe cam blocking guard prevents egress of other syringes contained within the syringe magazine, engaging the at least one syringe with at least one gripper assembly; placing the at least one syringe in a filling block and holding the syringe in place, filling the at least one syringe with liquid, moving the at least one syringe to engage at least one cap array, and placing a cap on the at least one syringe. Further, the inclined slope may be inclined at 10 degrees. Still, the at least one syringe may be oriented within the at least one syringe magazine and syringe cam with a Luer lock of the at least syringe oriented downward. Yet further, the at least one syringe cam may be biased to return to engage another syringe contained in the at least one syringe magazine. Again still, the gripper assembly may be disassembled to replace portions of the gripper assembly. Moreover, the method may include securing syringe caps via a cap array. Still yet again, the method may include aerodynamically shaping the filling block to promote air flow around the filling block. Furthermore, the method may include pneumatically powering the at least one syringe cam.

These and other aspects, objects, features, and advantages of the example embodiments will become apparent to those having ordinary skill in the art upon consideration of the following detailed description of example embodiments.

BRIEF DESCRIPTION OF THE DRAWINGS

The construction designed to carry out the disclosure will hereinafter be described, together with other features thereof. The disclosure will be more readily understood from a reading of the following specification and by reference to the accompanying drawings forming a part thereof, wherein an example of the disclosure is shown and wherein.

Figure 1:
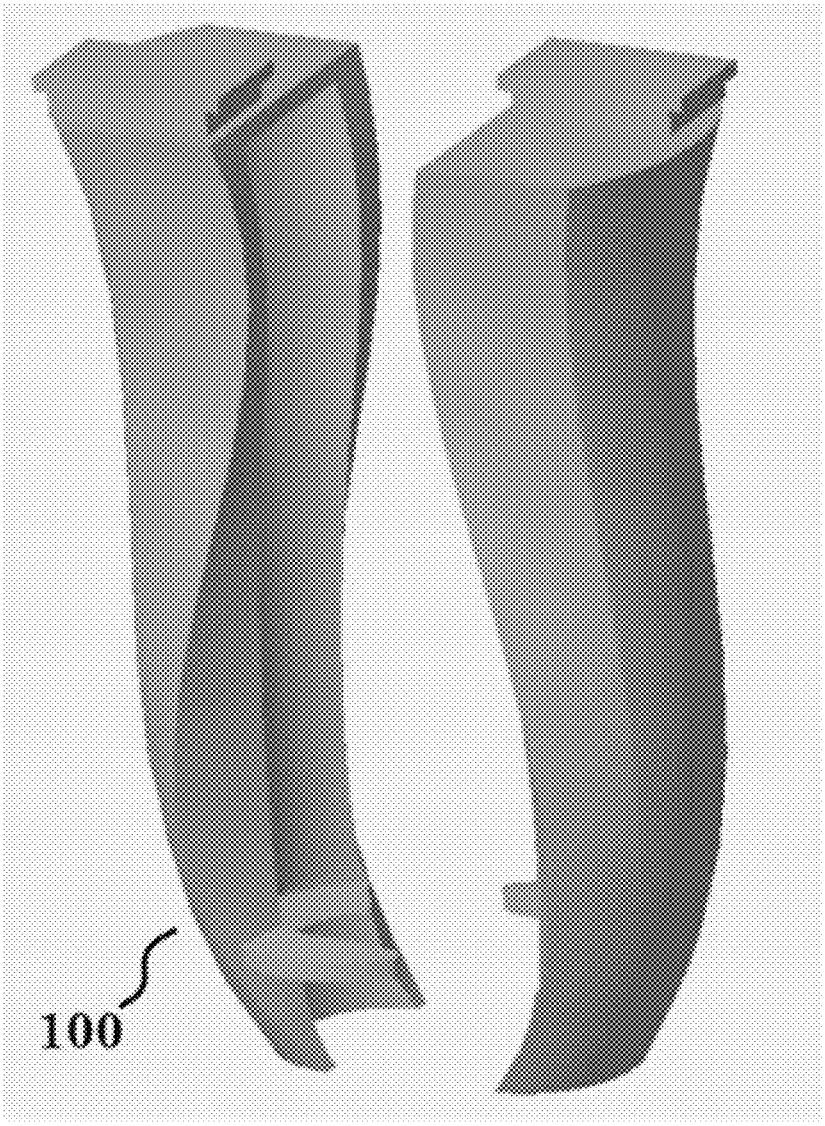
FIG. 1 shows one embodiment of gripper fingers of the current disclosure.

The figures herein are for illustrative purposes only and are not necessarily drawn to scale.

It will be understood by those skilled in the art that one or more aspects of this disclosure can meet certain objectives, while one or more other aspects can meet certain other objectives. Each objective may not apply equally, in all its respects, to every aspect of this disclosure. As such, the preceding objects can be viewed in the alternative with respect to any one aspect of this disclosure. These and other objects and features of the disclosure will become more fully apparent when the following detailed description is read in conjunction with the accompanying figures and examples. However, it is to be understood that both the foregoing summary of the disclosure and the following detailed description are of a preferred embodiment and not restrictive of the disclosure or other alternate embodiments of the disclosure. In particular, while the disclosure is described herein with reference to a number of specific embodiments, it will be appreciated that the description is illustrative of the disclosure and is not constructed as limiting of the disclosure. Various modifications and applications may occur to those who are skilled in the art, without departing from the spirit and the scope of the disclosure, as described by the appended claims. Likewise, other objects, features, benefits and advantages of the present disclosure will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

Unless defined otherwise, technical and scientific terms used herein have the same meaning as commonly understood by one of ordinary skill in the art to which this disclosure pertains. Definitions of common terms and techniques in molecular biology may be found in Molecular Cloning: A Laboratory Manual, 2nd edition (1989) (Sambrook, Fritsch, and Maniatis); Molecular Cloning: A Laboratory Manual, 4th edition (2012) (Green and Sambrook); Current Protocols in Molecular Biology (1987) (F. M. Ausubel et al. eds.); the series Methods in Enzymology (Academic Press, Inc.): PCR 2: A Practical Approach (1995) (M. J. MacPherson, B. D. Hames, and G. R. Taylor eds.): Antibodies, A Laboratory Manual (1988) (Harlow and Lane, eds.): Antibodies A Laboratory Manual, 2nd edition 2013 (E. A. Greenfield ed.); Animal Cell Culture (1987) (R. I. Freshney, ed.); Benjamin Lewin, Genes IX, published by Jones and Bartlet, 2008 (ISBN 0763752223); Kendrew et al. (eds.), The Encyclopedia of Molecular Biology, published by Blackwell Science Ltd., 1994 (ISBN 0632021829); Robert A. Meyers (ed.), Molecular Biology and Biotechnology: a Comprehensive Desk Reference, published by VCH Publishers, Inc., 1995 (ISBN 9780471185710); Singleton et al., Dictionary of Microbiology and Molecular Biology 2nd ed., J. Wiley & Sons (New York, N.Y. 1994), March, Advanced Organic Chemistry Reactions, Mechanisms and Structure 4th ed., John Wiley & Sons (New York, N.Y. 1992); and Marten H. Hofker and Jan van Deursen, Transgenic Mouse Methods and Protocols, 2nd edition (2011).

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g. given data set, art accepted standard, and/or with e.g. a given confidence interval (e.g. 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

As used herein, "water-soluble", generally means at least about 10 g of a substance is soluble in 1 L of water, i.e., at neutral pH, at 25° C.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

The current disclosure helps overcome industry issues such as using electronic equipment, which would be exposed to spray and concentrated cleaning compounds. Indeed, pneumatic operated systems are preferred as they avoid the inherent problems with electronic equipment, especially in frequently sanitized areas.

In one aspect, the current disclosure provides a syringe dispenser: The apparatus translates a single syringe from among a group of syringes, and may partially rotate it to an orientation suitable as a pick point for a robotic process. It does so reliably and accurately. This is in association with syringe gripper fingers wherein parts of the end effector grasp the syringe, secure the syringe with respect to axial, translation, and rotational constraints while using minimal gripping force and allowing the plunger to fully extend. There may also a pump nozzle/syringe interface, syringe cap dispenser, and a robot base. The robot, which may be a YASKAWA MOTOMAN GP8, will be attached to a base, which will maintain the stability of the system, and ensure all operations are conducted with precise pick points within the ISO 5 hood environment. This disclosure will operate in parallel with the robot to enable a smooth transition point and a linearly flowing system. This device will provide a precise pick point from which the robot may obtain new syringes.

In one aspect, the syringe dispenser removes a single syringe from a group and orients it in a location by itself so that a robot arm can grasp it to perform an operation in a process. It reliably controls the location and orientation of the syringe to ensure a consistent pick-point throughout the process. The syringe gripper fingers grip the syringe and prevent it from moving while operations are performed. The pump nozzle/syringe interface secures the syringe while it is being filled with liquid. The syringe cap dispenser secures the caps so they can be attached to each filled syringe.

In a further aspect, with respect to the syringe dispenser, syringes are introduced to a process in bulk and in random orientations. It is necessary to separate a single syringe from the others and orient it so that a robot may grasp it reliably. To do so manually is impractical. Controlling the orientation and location of a single syringe at a time is the first solution in automating a robotics process. Further, the syringe gripper fingers hold a syringe securely while allowing for normal operation of the syringe plunger. The robot base will allow for exact points of contact from which the robot may operate. The assembly must be capable of relocation, and be able to lock into a stationary position. Finally, the base must be able to withstand routine cleanings with corrosive chemicals. The current disclosure works more fluidly with an automated system and has an exceptionally low rate of failure and is quick and easy to set up and maintain.

Figure 2:
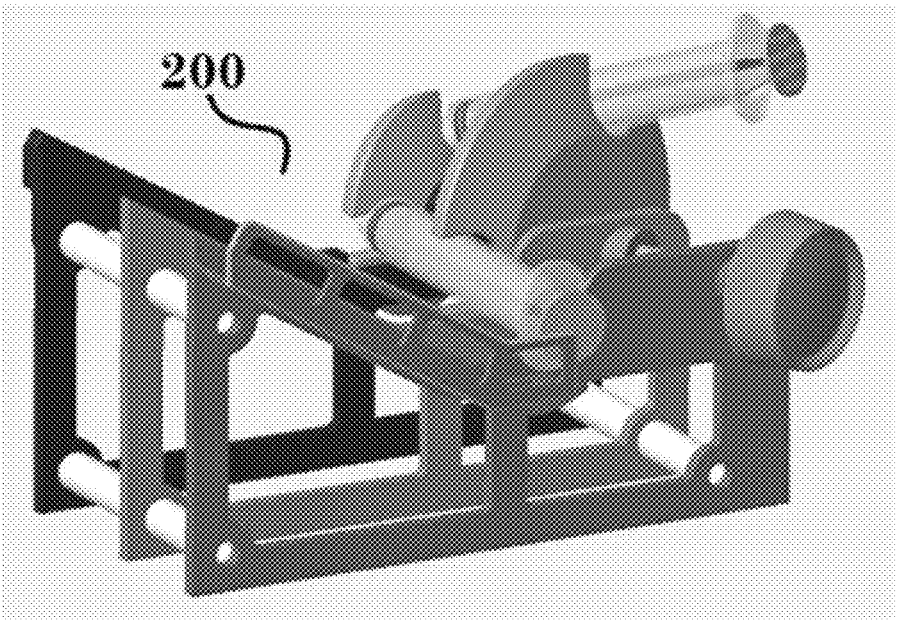
FIG. 2 shows one embodiment of a syringe dispenser of the current disclosure.

FIG. 1 shows one embodiment of gripper fingers 100 of the current disclosure. FIG. 2 shows one embodiment of a syringe dispenser 200 of the current disclosure.

In a further aspect, the gripper may have the following construction. An IP rating of 65 or greater, ISO 5 cleanroom compatible, 16 mm minimum stroke, height restricted to ensure compatibility within a 6 foot hood, and gripping force greater than 17.64 N. Gripping force $F=(mg/n\mu)*a$, may be calculated via F=Gripping force (N), $\mu$=Coefficient of friction (calculated at 0.2), mg=Work piece weight (0.018*9.8=0.1764 N), n=# of fingers (2), and a=Safety margin of error (calculated at 4). One possible solution is a PTM Mechatronics PTM SG50-CR which is ISO 5 compatible from factory, has Ingress Protection Rating of IP68, digital operation, a 25-mm stroke per jaw, RS485 serial Interface, max gripping force of 50-N, and a height of 103 mm.

Further, a Zimmer GPP5010N-00-A may be used which has pneumatic operation (43 Psi min, 116 Psi max), 44 air volume per cycle, Ingress Protection Rating of IP67 (with purged air) PTM SG50-CR, 10-mm stroke per jaw, Max gripping force of 885-N (in closing), and a height of 81 mm.

Figure 3:
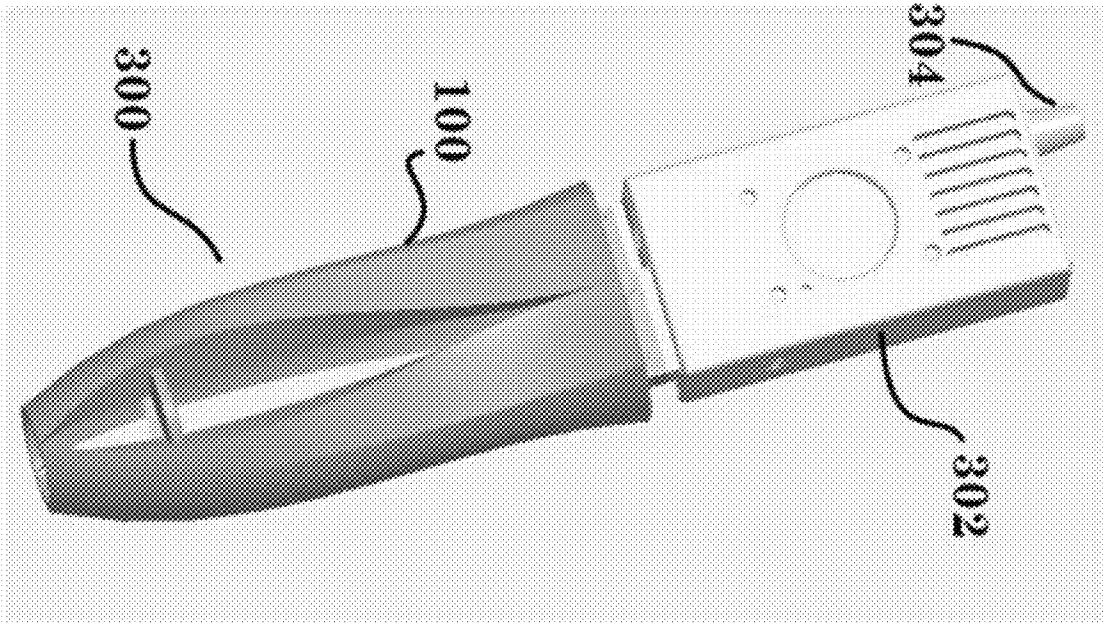
FIG. 3 shows one embodiment of gripper fingers that may be used as part of the current disclosure.
Figure 4:
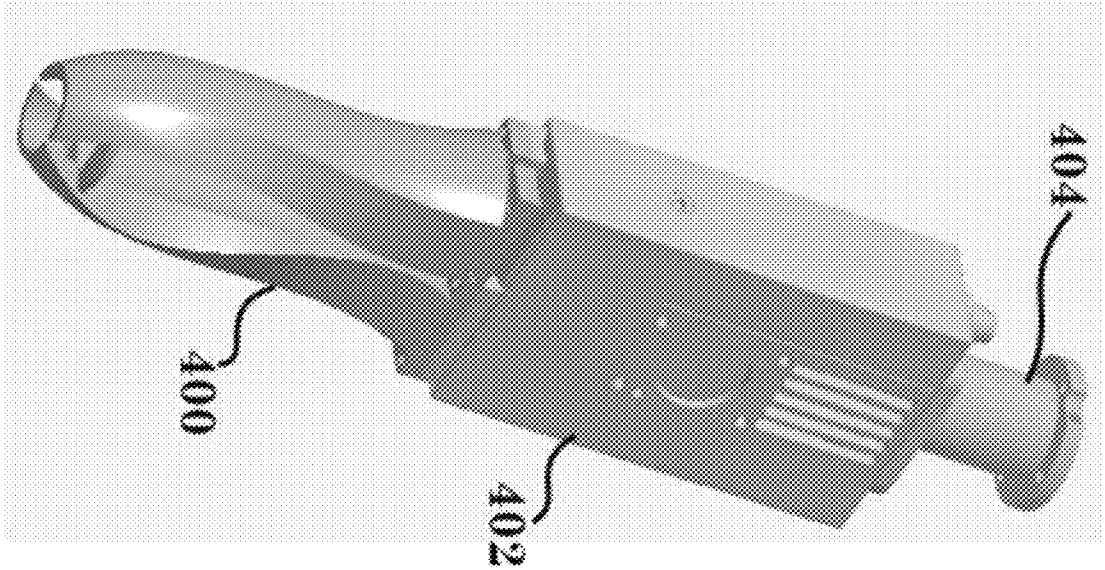
FIG. 4 shows an alternate gripper configuration of the current disclosure.

Gripper fingers may provide axial, translational, as well as rotational constraint. In one instance, see FIG. 3, gripper fingers 100 may be joined into a conjoined gripper 300 via attachment to a gripper body 302. Gripper fingers 100 may be 4 inches tall, with gripper body 302 being 3 inches tall, but the current disclosure should not be considered so limited and other length variants are considered with the scope of the disclosure. Coupler 304 connects conjoined gripper 300 to a robot, such as a YASKAWA MOTOMAN GP8, or articulated armature, not shown. FIG. 4 shows an alternate gripper configuration wherein the gripper fingers 400 are 4 inches tall and the gripper body 402 is 4 inches tall and coupler 404 is 1 and ⅜ inches long.

The current disclosure may also include a peristaltic pump, such as a Masterflex 07575-70 L/S, that may have the following specifications: Max flow rate 3400 mL/min, Min flow rate 0.006 mL/min, IP66 (Washdown capable), fully digital operation, cloud compatibility, brushless, maintenance-free motor, ±0.1% speed control accuracy, and a remote I/O. The pump may also include a leak detector sensor that will shut the pump down in less than one second. The current disclosure may also include a PLC, such as a Siemens Simatic S7-1500, with less than 1 ns bit processing time in cpu, and PROFINET interface (Ethernet/IO) for defined response times and precise machine behavior.

Figure 5:
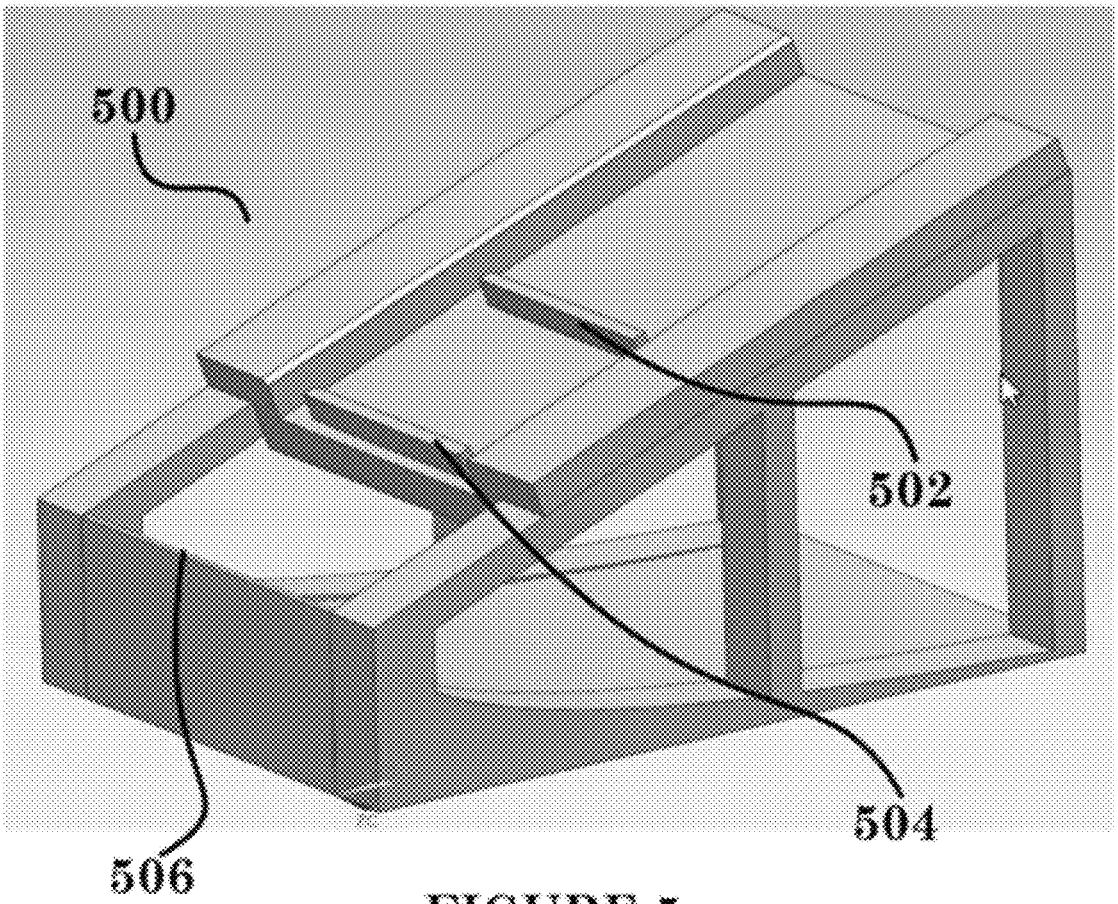
FIG. 5 shows a capping dispenser that may be used as part of the current disclosure.
Figure 6:
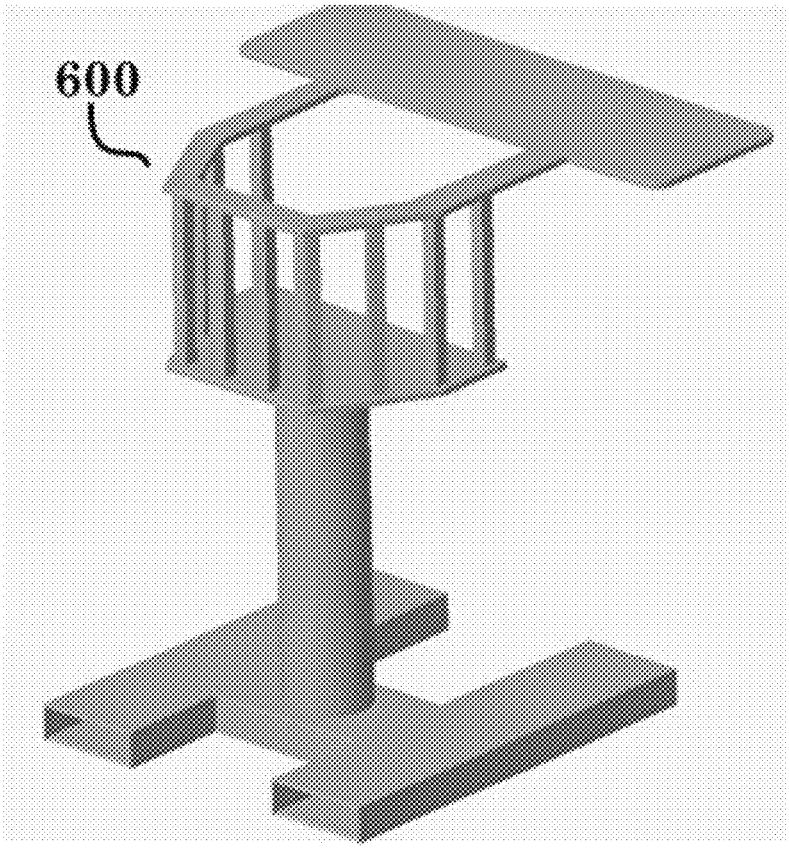
FIG. 6 shows one embodiment of a base that may be used with the current disclosure.

FIG. 5 shows a capping dispenser 500 that may be used as part of the current disclosure. Capping dispenser 500 may be gravity fed and include first gate 502 and second gate 504. Gates 502 and 504 may receive signals to rise and fall in accordance with the preparation process and a cap package, not shown, may be dispensed at distal end 506. FIG. 6 shows one embodiment of a base 600 that may be used with the current disclosure.

Figure 7:
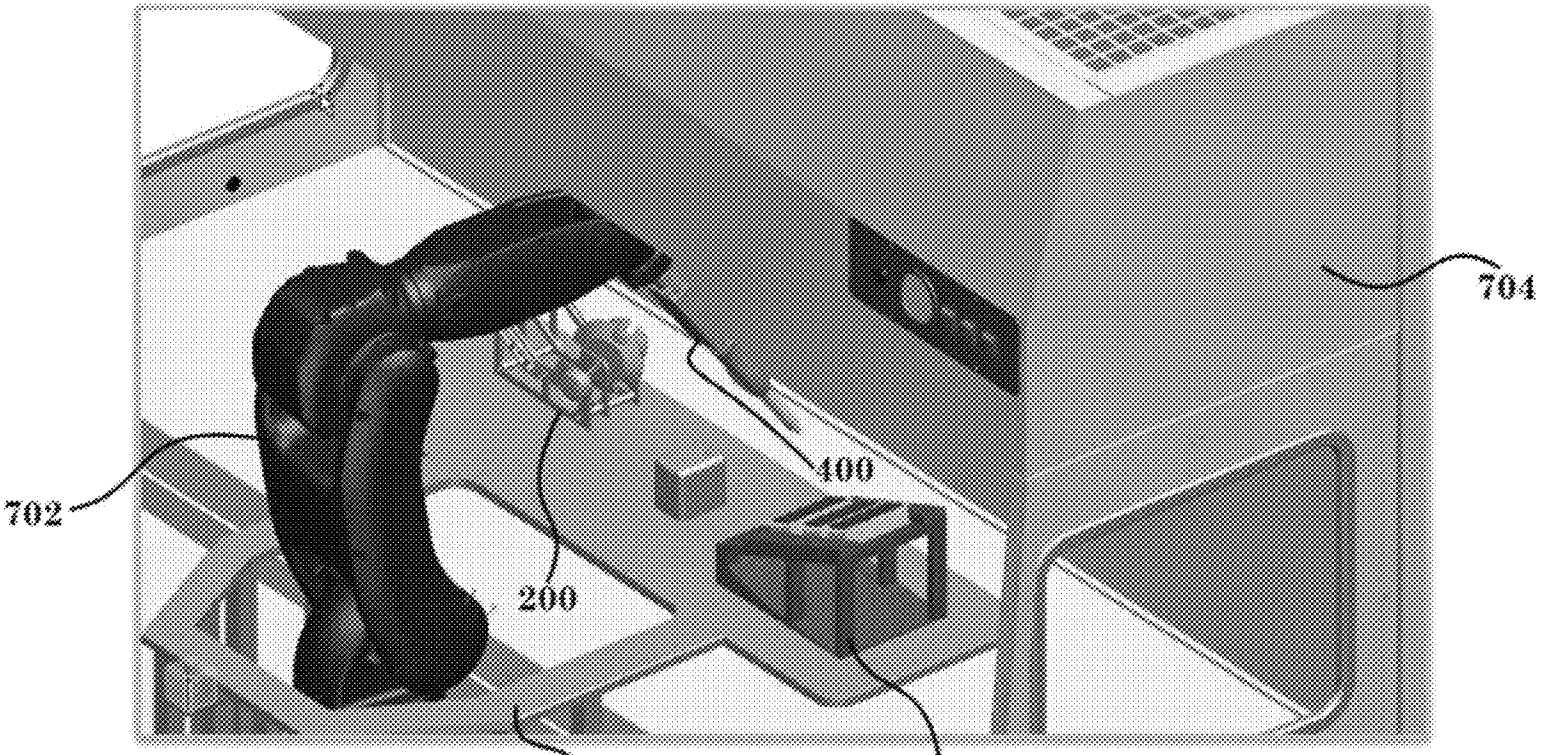
FIG. 7 shows one embodiment of an assembly system of the current disclosure.

FIG. 7 shows one embodiment of a system 700 of the current disclosure wherein robot 702, which may be a YASKAWA MOTOMAN GP8, uses gripper fingers 400 to work in conjunction with base 600, capping dispenser 500, and syringe dispenser 200 under a hood 704 to assemble syringes or other medical devices.

The components of the systems of the current disclosure may be formed from plastics, synthetics, metals, or other materials as known to those of skill in the art in the medical devices industry.

In a further embodiment, the current disclosure provides a system for replacing a currently manual, i.e., requires a human employee to complete, process that is currently used at Nephron Pharmaceuticals. In this embodiment, many components are made from 316 stainless steel to allow for autoclave usage for sterilization. This improves sterility and helps ensure "clean room" type conditions for use of the system.

Currently, multiple operators must manually fill syringes in a sterile environment. One of the largest sources for contaminants in a sterile environment is via direct human interaction. This disclosure aims to completely reduce and/or eliminate human interaction with critical sterile locations, which might otherwise present a potential contaminate risk to a product. Currently, the automated system only requires operators to do one of three tasks. The first task is to sterilize packaged containers of syringes and caps and introduce them in bulk to the sterile environment. The second task is to open the packages and load syringes from the packages into the Syringe Magazine. This task must be manual for three reasons. There is currently no visual system to ensure the syringes are properly oriented. While in the packages, the syringes are in random orientations. To wit, the syringes are randomly oriented with respect to one another and one package will have a completely different random orientation of the syringes contained therein with respect to another package of syringes. It is not feasible to have a robot attempt to pick an object without precise prediction of location or orientation of the syringes. Here, the robot's gripper is oriented in such a way that filling and capping is possible. However, this design makes it impossible to pick syringes properly from the packages given their random/chaotic placement with respect to the gripper on the system.

One issue cured by the current disclosure is that the robot can only operate so fast. If it had to locate and pick syringes from a package, again with the syringes randomly/chaotically oriented within same, the overall operating efficiency would be greatly reduced as the arm would have to "hunt and pick" with every syringe selected from the syringe package.

The third task is to open and load cap packages into the Cap Array. The packages come from different molds and have slight variations in tolerance.

The current system requires operators to fill an array with six (6) cap packs and place it in the appropriate location in the Segmented Shelf. Upon depleting this array, the robot will move to a neutral position and wait for the operator to replace the array with a fresh, loaded second array.

This system has multiple redundant safety measures, which may include the PLC having redundant safety relays. These relays are built in series with one another (like lightbulbs wired in series instead of parallel). This ensures that if any one safety device of the system activates or fails, everything will come to a stop in a safe manner. There are also safety precautions taken with regards to the pneumatics. There is a soft start up valve installed on the pneumatic lines to prevent undesired intense actuation of parts. Should production need be stopped for any safety reason, then pneumatics will immediately be vented from the system through the regulator.

The system also includes physical safety barriers, which aim to limit entry of operators into the robot's operating zone. The top frame of the robot may be enclosed with static polycarbonate. The sides may be enclosed with static polycarbonate. The right side of the base has an extension of polycarbonate to block operators from interfering with robot operations. This sheet of polycarbonate can be removed for cleaning and exchanging of parts but must be returned prior to resuming production. This is ensured by a mechanical safety interlock that requires the presence of the polycarbonate sheet before production may resume.

The rear side of the base may include a removable sheet of polycarbonate. This sheet of polycarbonate can be removed for cleaning and exchanging of parts but must be returned prior to resuming production. This may also be ensured by a mechanical safety interlock.

The syringe magazine for the current system should be built at substantially a 10 degree slope. The slope may be measured from the horizontal plane or the surface supporting the syringe magazine. An angle of less than 10 degrees will not guarantee proper slippage of syringes, whereas an angle of more than 10 degrees will cause issues when transferring syringes from the Syringe Magazine to the Syringe CAM. Special attention needs to be given to the syringe magazine with regards to sterility. It is desired to provide a large capacity for syringes, but this design must be in a straight line parallel to the back of the hood. This helps maintains laminar and uninterrupted sterile air flow from the back of the hood across the tips of the syringes. Suitable parts may be formed from DELRIN® products available from Dupont. These are more readily replaced and have more manufacturing flexibility and manipulability with regards to design and/or pieces formed from TEFLON® to reduce friction and encourage syringe movement along the syringe slide rail of the syringe magazine. Frame pieces may be formed from stainless steel stock or strips.

The Syringe CAM uses a rotary actuator from SMC (11-MSQB10A). This component works with the Syringe Magazine to translate individual syringes from the Syringe Magazine to a location suitable for picking of the gripper assembly. This syringe cam finger takes and holds individual syringes from the Syringe Magazine. A 10 degree angle, as discussed supra, should be given to the radius of this quarter-circle. This angle should match the angle of the Syringe Magazine. This angle should also match the angle of a coupler and the rotary actuator that resembles a dumbbell in appearance. A coupler is located between the rotary actuator and the segmented shelf.

Earlier versions of the Gripper Fingers were going to be expensive and difficult to manufacture out of 316 stainless steel. This was solved by segmenting the gripper fingers into three (3) parts. This design change was further improved in Version 2.0 that disclosed a set of gripper fingers incorporating rubber O-ring into the design to improve performance. By adding rubber to the fingers, a barrier was added to prevent scratching of the syringe on the stainless-steel gripper fingers. This scratching could erode the graduation marks on the outside of the syringe, which is unacceptable. This rubber insert also aids in controlling the torque applied during capping of syringes. This design requires precise manufacturing. The holes for the O-ring must be drilled prior to drilling the main radius in which the syringe will sit. Very precise dimensions must be achieved. Imprecision will result in improper seating of syringes in the fingers and may result in major misalignments during operation.

Currently, this component uses a Schunk MPG 50 parallel gripper. A coupler between the Schunk gripper and the arm of the robot is the top segment of the Segmented Gripper Fingers. There is also a middle segment of the Segmented Gripper Fingers and a bottom segment of the Segmented Gripper Fingers that may also have an end piece below the bottom segment. This piece may holds rubber O-ring stock inside the bottom segment.

The Filling Block houses the filling nozzle through which medicine may be passed from a reservoir into the syringe. The tube set may be purchased from Bausch and sterilized via gamma-irradiation. The nozzle may be a Luer slip fit and made from the PEEK material. This component was designed to reduce air disturbance by using a pointed aerodynamic design. The filling body may include a main body and a finger used to lock the nozzle into a stationary position. The finger prevents motion of the nozzle in the X and Y directions and rotates about a shoulder bolt and is locked into place with a thumb screw. A fitting may be used to prevent motion of the nozzle in the Z direction.

The cap array includes a cap tray. This tray takes into account the varying sizes of provided cap packages, such as with cap packs 5, 6, 7, and 8. These variations in cap pack dimensions are likely due to different molds used in production of the packages themselves. The cap array may also include at least one locating pin for the Cap Array. These pins must be made very precisely. Failure to make them accurately can result in capping failures during production.

The base of the system may have three (3) sections. The lower section is manufactured from 2"×2" (0.25" thick walls) square tubing. This section is the anchor for the base. The center of mass should be low enough to prevent both tipping from moments influenced by the robot, such as a YASKAWA MOTOMAN GP8. Data for these momentum and force values can be found in the YASKAWA MOTOMAN GP8 manual. This section may be entirely encased with sheet metal. The interior of this section may house an electronics cabinet and robot controller. Therefore, it is necessary to close any open spaces or gaps between metal with a sealing agent. The upper section may be manufactured from 1"×1" (0.125" thick walls) square tubing. This section is meant to provide a physical barrier between the operator and machine. Polycarbonate may encase the area in which the robot is housed. Holes must be cut in the polycarbonate to facilitate proper air ventilation.

The final section is located within the lower section. This is the electrical cabinet, which houses the PLC, Controller, and Pneumatic solenoids. This section needs to be ventilated by 72 Cubic feet per minute. The Base houses the robot and limits operator interaction with mobile parts during production.

The system also may include Segmented Shelves. A high level of precision is required for accurate and repeatable automated practices. However, there are many factors which cannot be controlled from a broad design aspect. Therefore, this system has been designed to allow for some adjustability for operators and maintenance.

This system was designed with the intention of being installed in an eight (8) foot (length) laminar flow hood. Clean rooms will not all be built exactly the same. There may be slight sloping across the floors, which cannot be accurately predicted. Clean room hoods may not be built exactly the same. The base and shelves have been designed with adjustability to be raised and lowered to account for this, but initial installation must be done precisely. Because of potential inconsistencies in cleanrooms and hoods, the shelves each can be adjusted individually. Every batch, operators will need to use the provided bubble level to ensure the shelves are level with respect to each other.

Figure 8:
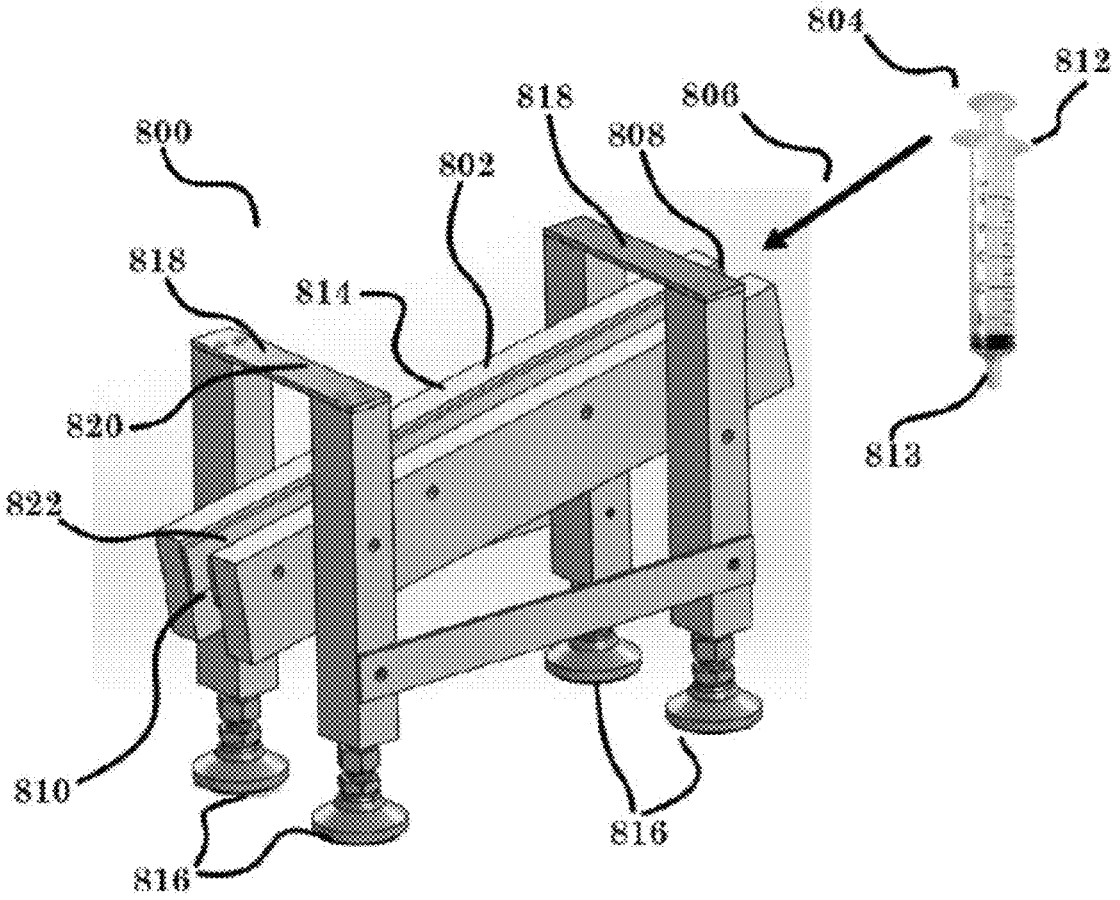
FIG. 8 shows an alternative embodiment of a syringe magazine.

In a further embodiment, the current disclosure provides systems and methods for automatically filling syringes. FIG. 8 shows a syringe magazine 800. Magazine 800 may be formed from DELRIN®, TEFLON®, stainless steel, 3-D printed materials, resins, synthetics or other materials as known to those of skill in the art. These materials may be changed later based on individual future needs. Syringe magazine 800 may include syringe slide rail 802, which guides a syringe 804 as shown by arrow 806 into syringe rail opening 808 so that syringe 804 glides down syringe slide rail 802 and exits via syringe rail exit 810. Syringe slide rail 802 may be formed from TEFLON® or other low-friction materials to encourage sliding of syringes along syringe slide rail 802 without the need for lubricants, which may introduce pollutants into the system.

Moving down slide rail 802 via the direction of arrow 806 places syringe barrel flange 812 moving over syringe rail sliding surface 814 until exiting via syringe rail exit 810. Thus, syringe 804 is positioned with Luer lock end 813 pointed down toward the surface supporting syringe magazine 800 throughout syringe slide rail 802. Syringe magazine 800 may be formed with multiple adjustable legs 816 that may allow height adjustment of syringe magazine 800 to accommodate different operational setups and to help maintain syringe slide rail 802 at substantially a 10 degree angle from horizontal so that syringe 804 is impelled along syringe slide rail 802 but not so fast that syringes would "log jam" into one another and prevent movement within syringe magazine 800.

Further, the mechanical slide effect provided by the 10 degree slope of syringe slide rail 802 does away for the need for motorized movement along slide rail 802, reducing the complexity, maintenance requirements, and price of the system in use. Different size/diameter syringes may be accommodated via use of syringe spacers 818. Spacers 818 may be of a fixed width and replaced to widen or narrow syringe rail slot 822 or spacers 818 may be adjustable along length 820 to allow spacers to expand or contract to accommodate different syringe barrel widths depending on the size of the syringe needed to be filled. Exchange of, or adjustable movement of, spacers 818 will result in opposing adjustable legs 816 being moved closer to or further from one another to accommodate different syringe barrel sizes. Supports 820 help to maintain stability of syringe magazine 800 by stabilizing legs 816.

Figure 9:
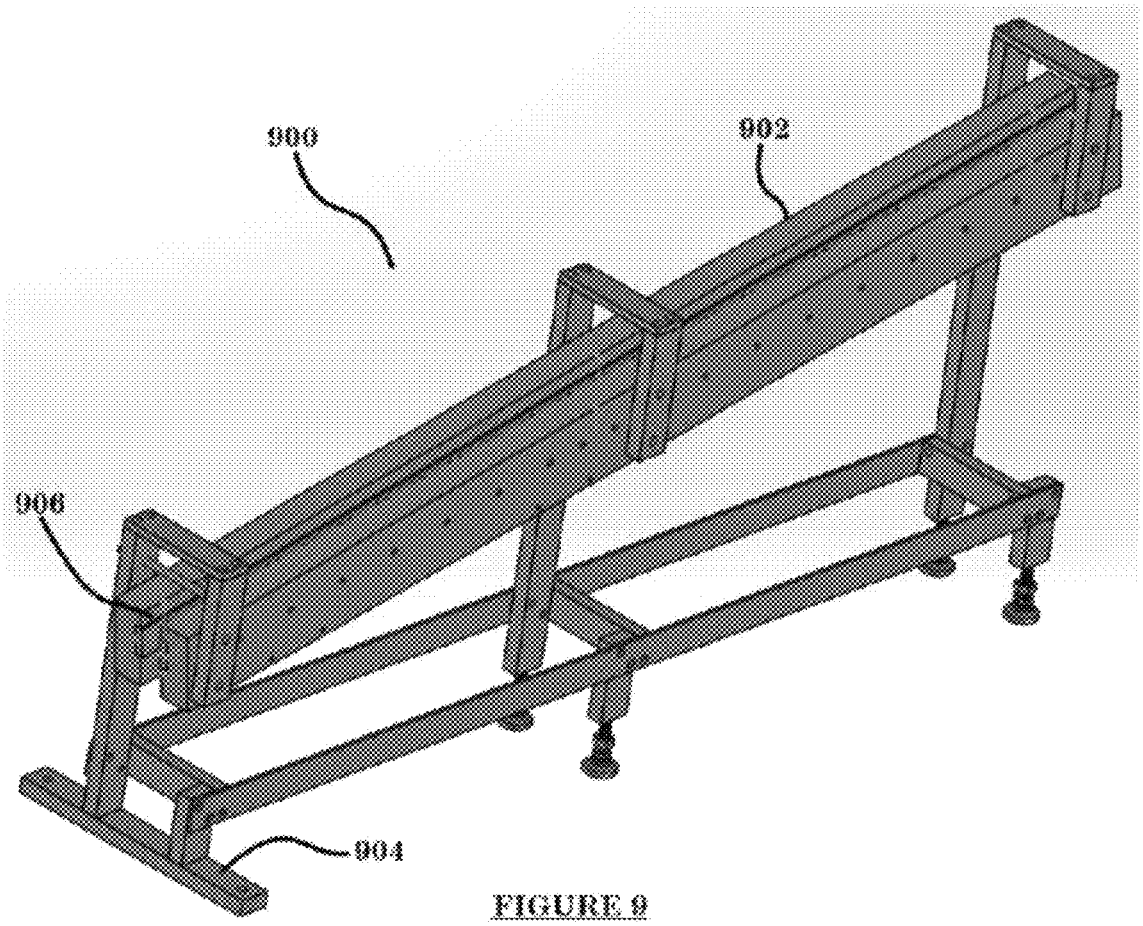
FIG. 9 shows an alternative embodiment of a syringe slide rail.

FIG. 9 shows an alternative embodiment of a syringe slide rail. Here, extended syringe magazine 900 has a longer extended syringe slide rail 902 as compared to syringe slide rail 802. The length of extended syringe slide rail 902 may be adjusted to fit the dimensions of a work area while maintaining the 10 degree slope of extended syringe slide rail 902 for efficient syringe movement. This malleability of the system allows for the components to be sized to fit various dimensioned chemical hoods, clean rooms, processing locales, etc., without requiring an extensive redesign of the system for efficient operation. Extended syringe magazine 900 may also include end brace 904 to support and maintain extended syringe rail exit 906 in position.

Figure 10:
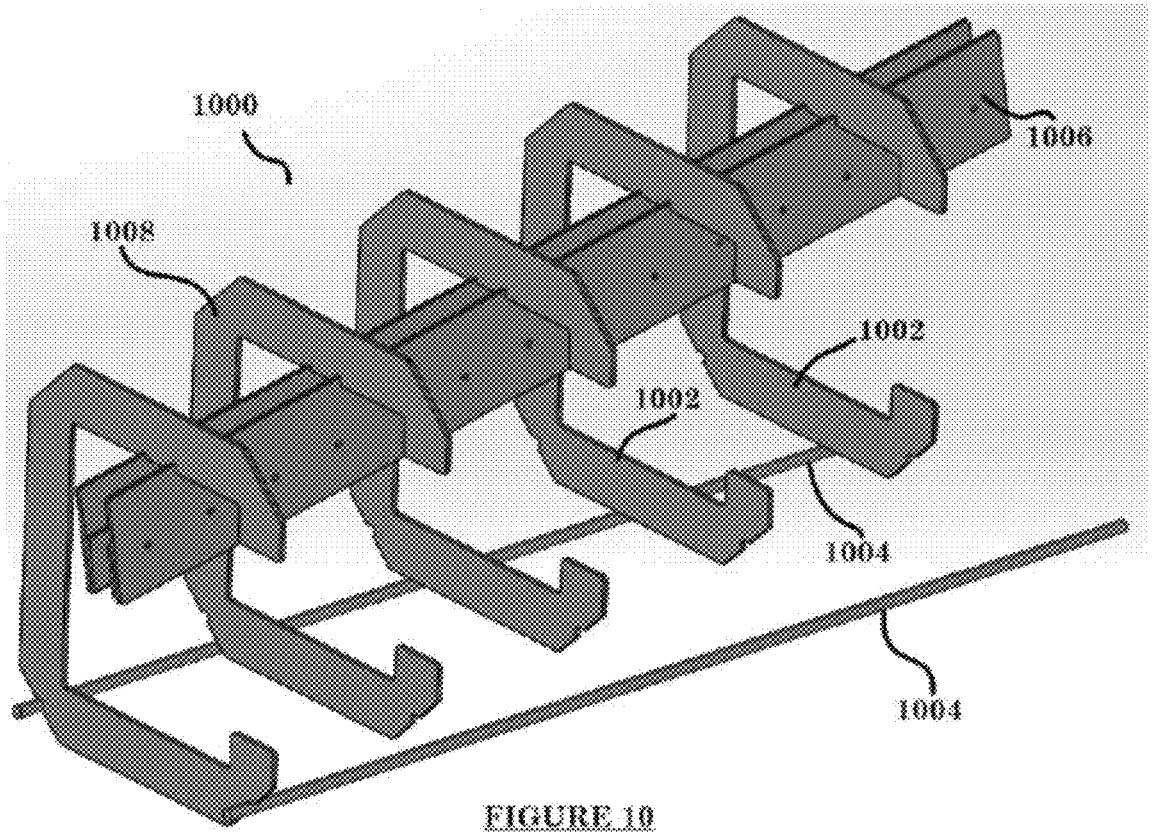
FIG. 10 shows a further embodiment of stylized syringe magazine.

FIG. 10 shows a further embodiment of stylized syringe magazine 1000 wherein the adjustable legs 816 have been replaced with fixed stanchions 1002 and support bars 1004 to allow for fixed support of stylized syringe slide rail 1006 for situations when a static syringe barrel width is contemplated for repeated/long term assembly. Fixed stanchions 1002 may be shaped in various styles or aesthetics, such as the University of South Carolina "C" 1008 shown in FIG. 10, while maintaining substantially a 10 degree incline along stylized syringe magazine slide rail 1006.

Figure 11:
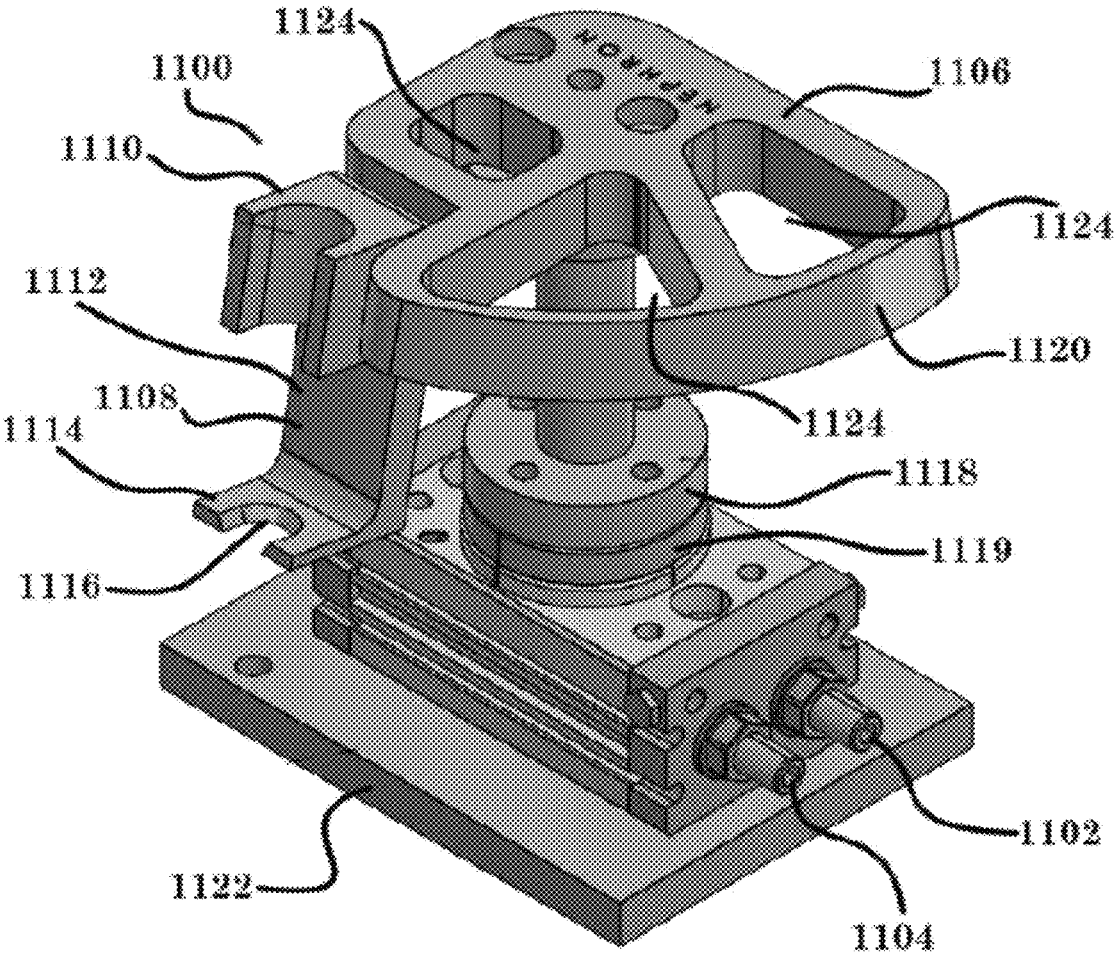
FIG. 11 shows one embodiment of a syringe cam.

FIG. 11 shows syringe cam 1100. Syringe cam 1100 may be pneumatically powered via input air line 1102 and output air line 1104. Air pressure 45 psi±5 psi, this pressure will be regulated internally within the robot base with a regulator through input air line 1102 causes cam platform 1106 to move from a first position wherein cam finger 1108 receives a syringe from syringe rail exist 810 such that the barrel flange of the syringe rests on cam syringe flange support 1110 and the barrel of the syringe lays against cam barrel support 1112 with the Luer lock of the syringe protruding through and supported by cam Luer lock support ridge 1114. Cam Luer lock support ridge 1114 may include inclined slope 1116 to further help "nest" the syringe within cam finger 1108. Thus, pneumatic air moves syringe cam 1100 via rotation of actuator coupler 1118 so that cam finger 1108 moves from engagement with syringe rail exit 810 with a syringe engaged with and carried by cam finger 1108 to then engage a finger gripper on a robotic arm, not shown and discussed infra. The CAM actuator will be locked in a 90 degree rotation. This rotation will be controlled/limited from the MSQB itself. While cam platform 1106 moves via actuator coupler 1118 being turned via being affixed to by turnstile 1119, which moves due to input air line 1102 providing air pressure, cam blocking guard 1120 slides into engagement with syringe rail exit 810 to hold the "stacked" syringes inclined on syringe slide rail 802 in place and prevent the next syringe, or any following, from prematurely exiting syringe slide rail 802. Once air pressure from input air line 1102 is cut off or removed via output air line 1104, cam platform 1106 returns to the first position wherein cam finger 1108 then receives a second syringe from syringe rail exit 810 to once again be actuated via pneumatic or other means to move the syringe cam 1100. The CAM is actuated via pneumatics. The pneumatics are controlled from a solenoid within the robot base, and are limited in their "acceleration" by flow restrictors. Flow restrictors are small valves that can be put in the middle of a pneumatic line to slow the initial velocity of air entering the lines. Syringe cam 1100 may also include a base coupler 1122 that may be used to secure syringe cam 1100 into place on a shelf or other surface. Syringe cam 1100 may also define at least one void 1124 within cam platform 1106 to reduce the mass of cam platform 1106. This helps prevent syringe cam 1100 from "slamming" back into place against syringe side rail 802 once the actuation force, whether pneumatic or otherwise, is removed from syringe cam 1100. Without these voids, syringe cam 1100 may incur vibrational damages as it repeatedly slams back into position. Voids 1124 reduce the mass, thereby reducing the force experienced when syringe cam 1100 returns to engage syringe slide rail 802.

Figure 12:
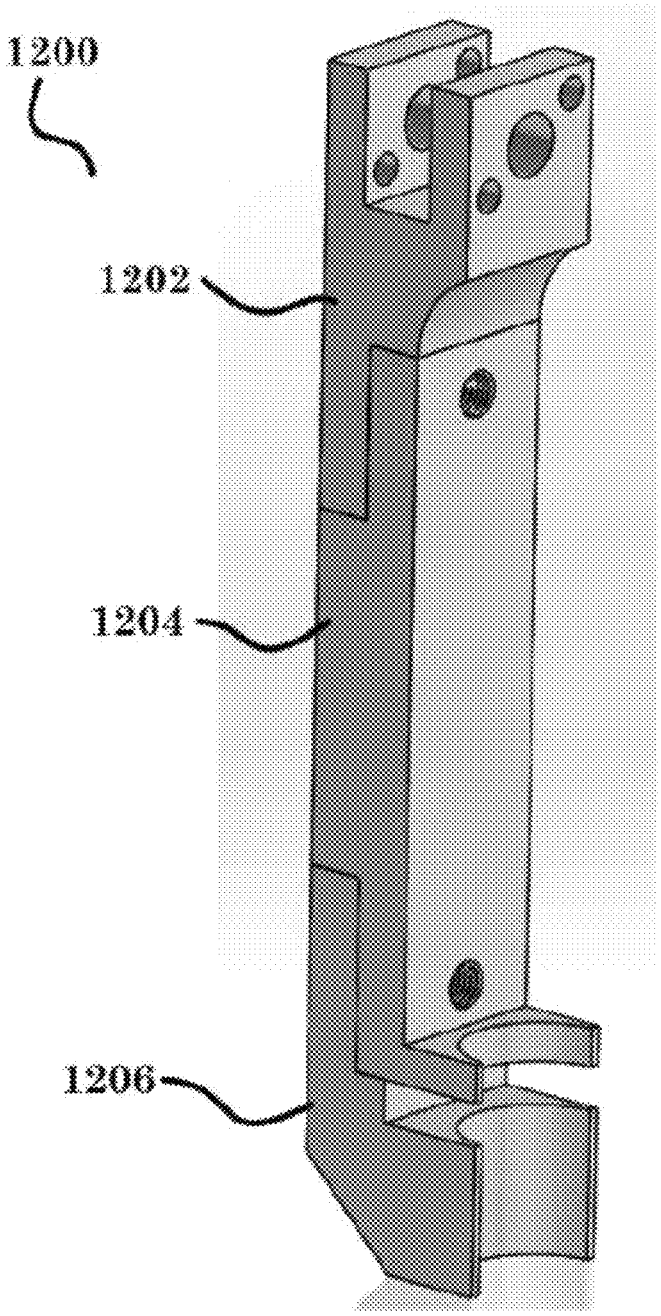
FIG. 12 shows one embodiment of a gripper assembly.

FIG. 12 shows a gripper assembly 1200 that may receive syringe 804 from syringe cam 1100. The gripper itself is a MPG-50 from Schunk, the gripper fingers must be made from electro polished 316 stainless steel, this material prevents potential contamination. All bolts are 316 Stainless steel. Gripper assembly 1200 may be a multi-piece structure comprised of a gripper assembly top segment 1202, gripper assembly mid segment 1204, and gripper assembly bottom segment 1206. This multi-part assembly allows for quick replacement of gripper assembly top, mid and bottom segment portions. This, in turn, allows one to accommodate a new size syringe, such as by replacing gripper assembly mid segment 1204 with a longer mid segment for syringes with longer barrels or replacing gripper assembly bottom segment 1206 with another bottom segment with a wider diameter to accommodate a wider/larger volume syringe. Further, gripper assembly top segment 1202 may be replaced to accommodate longer or shorter syringe plungers in order to allow for full filling of the syringe. If the top segment is too short, it may prevent fully filling the syringe.

Figure 13:
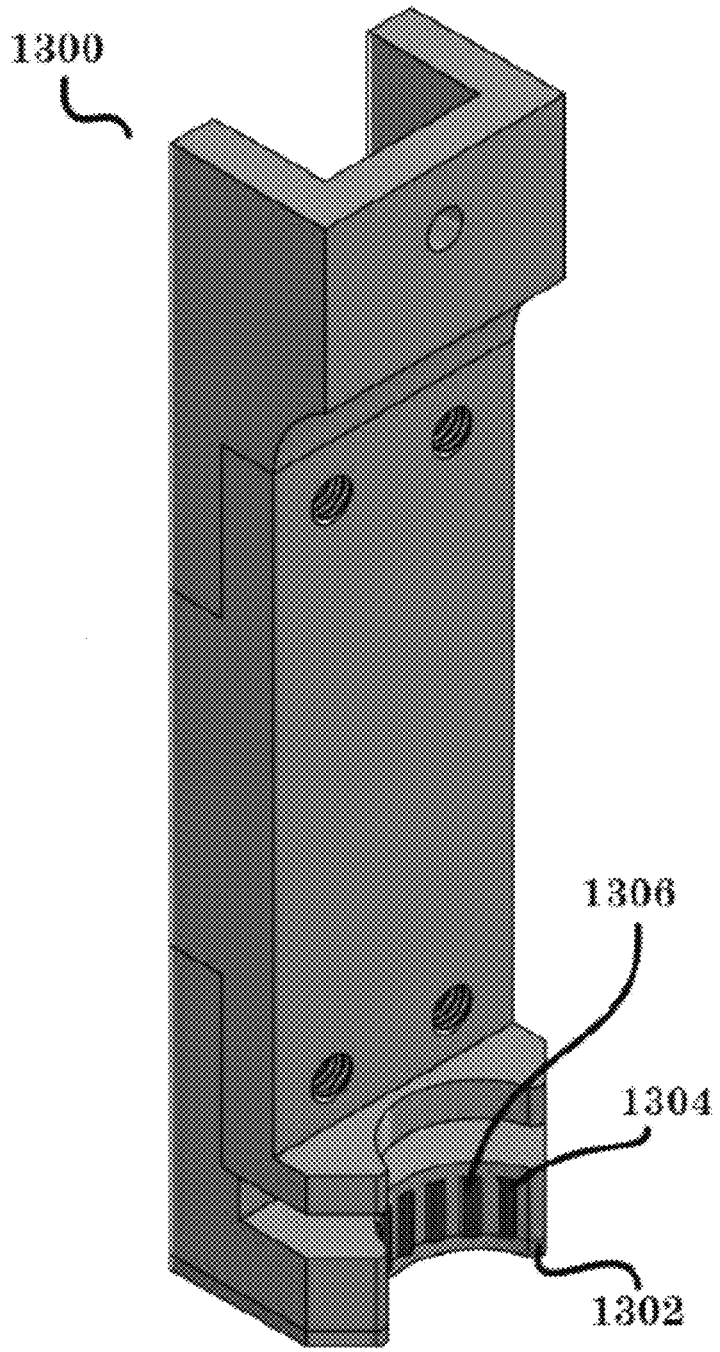
FIG. 13 shows an alternative gripper assembly.
Figure 14:
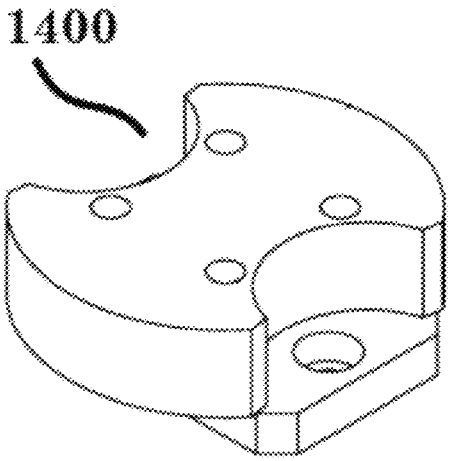
FIG. 14 shows one embodiment of a coupler of the current disclosure.

In a further embodiment, see FIG. 13, an alternative gripper assembly 1300 may include gripper assembly end cap 1302 may be included as well as gripper cavities 1304 that may be filled with an O-ring, polyurethane, rubber, nonwovens, or other suitable engagement material 1306 to reduce the chance of gripper assembly 1300 marring, scratching or otherwise damaging the barrel of a syringe held within gripper assembly 1300. Other materials may include anything that possesses a high level of friction but also allows for some elastic deformation of the material. This ensures that the syringe itself is protected, and the material will be exchanged after a determined number of syringes, but more importantly, the material must not compromise the sterility of the system. Gripper assembly 1200 and/or alternative gripper assembly 1300 may be manipulated by a robotic arm, not shown, such as a YASKAWA MOTOMAN GP8 or other model, via attaching the gripper, or a pair of grippers, to the robotic arm via a coupler 1400 as shown in FIG. 14. The gripper fingers each attach to one of the flanges of the MPG-50 gripper, and the gripper attaches to the bottom of the gripper coupler, and the gripper coupler attaches to the robot arm. It must be attached in this orientation in order to provide proper manipulation of the syringe. In this arrangement, a gripper or pair of grippers may be widened and/or narrowed to grasp and release a syringe. This combination also allows the gripper or pair of grippers to be positioned in the X, Y, and/or Z planes with respect to syringe cam 1100 so that a syringe may be "plucked" from syringe cam 1100 and then placed for filling the syringe. In a further embodiment, two gripper assemblies may work in tandem to "pluck" a syringe from syringe cam 1100 and surround, grip, as well as hold a syringe for filling.

Figure 15:
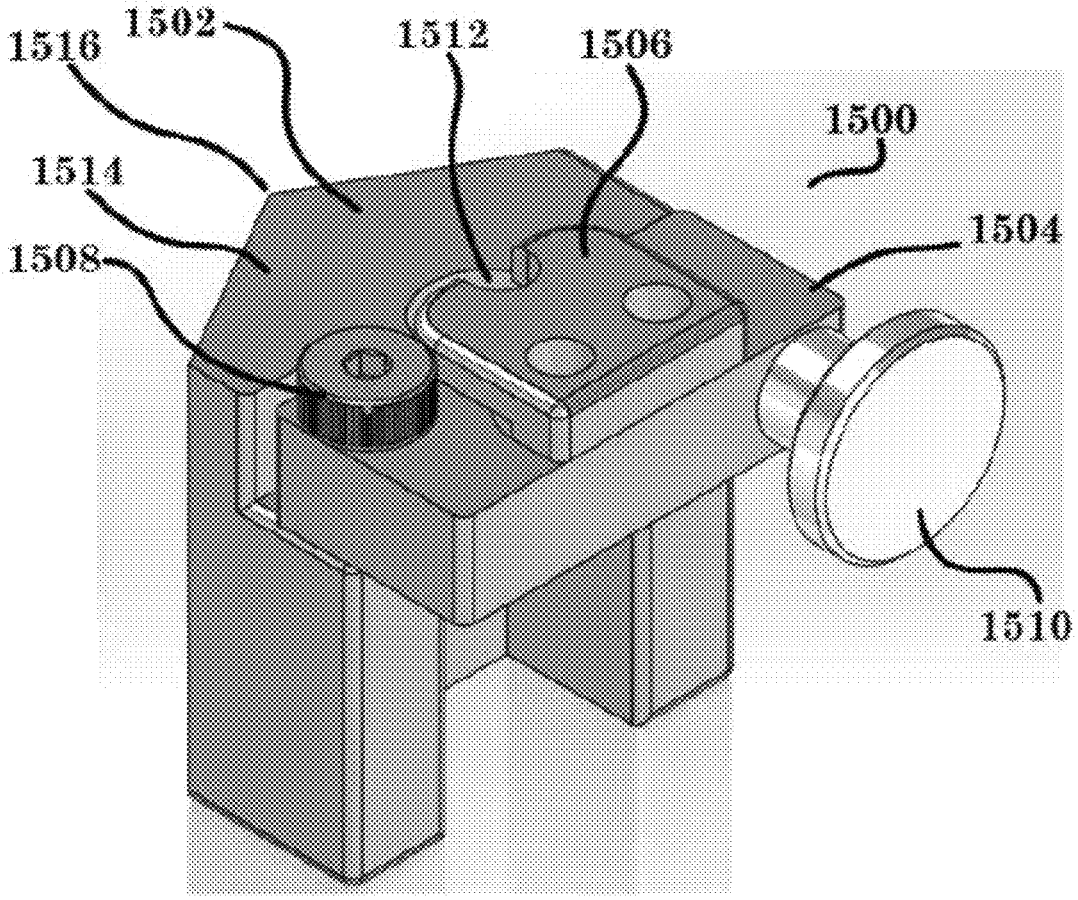
FIG. 15 shows one embodiment of a filling block of the current disclosure.

FIG. 15 shows filling block 1500. Filling block 1500 serves hold and secure the syringe while medicines, fluids, treatments, etc., are injected into the Luer lock end of a syringe, once a syringe is placed in filling block 1500 via gripper assembly 1200 or a pair of gripper assemblies 1200. Fluid filling may be accomplished via a tube set. Possible tube sets may be purchased from Bausch. This tube set may be locked into the filling fixture and provide a consistent filling location with respect to the robot. The tube set may be thrown away and replaced every batch, but the filling fixture may be autoclaved and replaced. Filling block 1500 may include main body 1502, filling finger 1504, fitting 1506, shoulder bolt 1508, thumbscrew 1510, and may define syringe cavity 1512 within main body 1502. As this stage, one the grippers/robotic arm place the syringe inside syringe cavity 1512, a user may secure the syringe for fluid injection. Failure to secure the syringe may result in spillage and contaminate the hood, clean room, etc. being used to fill the syringes. Once placed in syringe cavity 1512, the user may tighten shoulder bolt 1508 to vertically secure filling finger 1504 to main body 1502 and then tighten thumbscrew 1510 to secure filling finger 1504 horizontally to main body 1502. The part 1506 is the small fitting which attaches to the top of the finger for the filling fixture, it secures the Bausch tube set in the vertical direction. Once filling is complete, thumbscrew 1510 and shoulder bolt 1508 may be loosed to allow filling finger 1506 to partially or fully disengage from the syringe. At this step, gripper 1200 or a pair of grippers 1200 then reengage the syringe and move it to a cap array 1600. In addition, filling block 1500 may be aerodynamically shaped in order to promote air flow in and around the syringe. For example, and note intended to limit the possible aerodynamic features, filling block 1500 may have at least one face 1514 of main body 1502 shaped in an aerodynamically enhancing shape 1516, such as a wedge, arc, prong, vane, etc., to promote air flow around filling block 1500. The design of the main body of the filling fixture was built in such a way that it becomes aerodynamic. This is a benefit because it will reduce air disruptions in the system over this very critical location.

Figure 16:
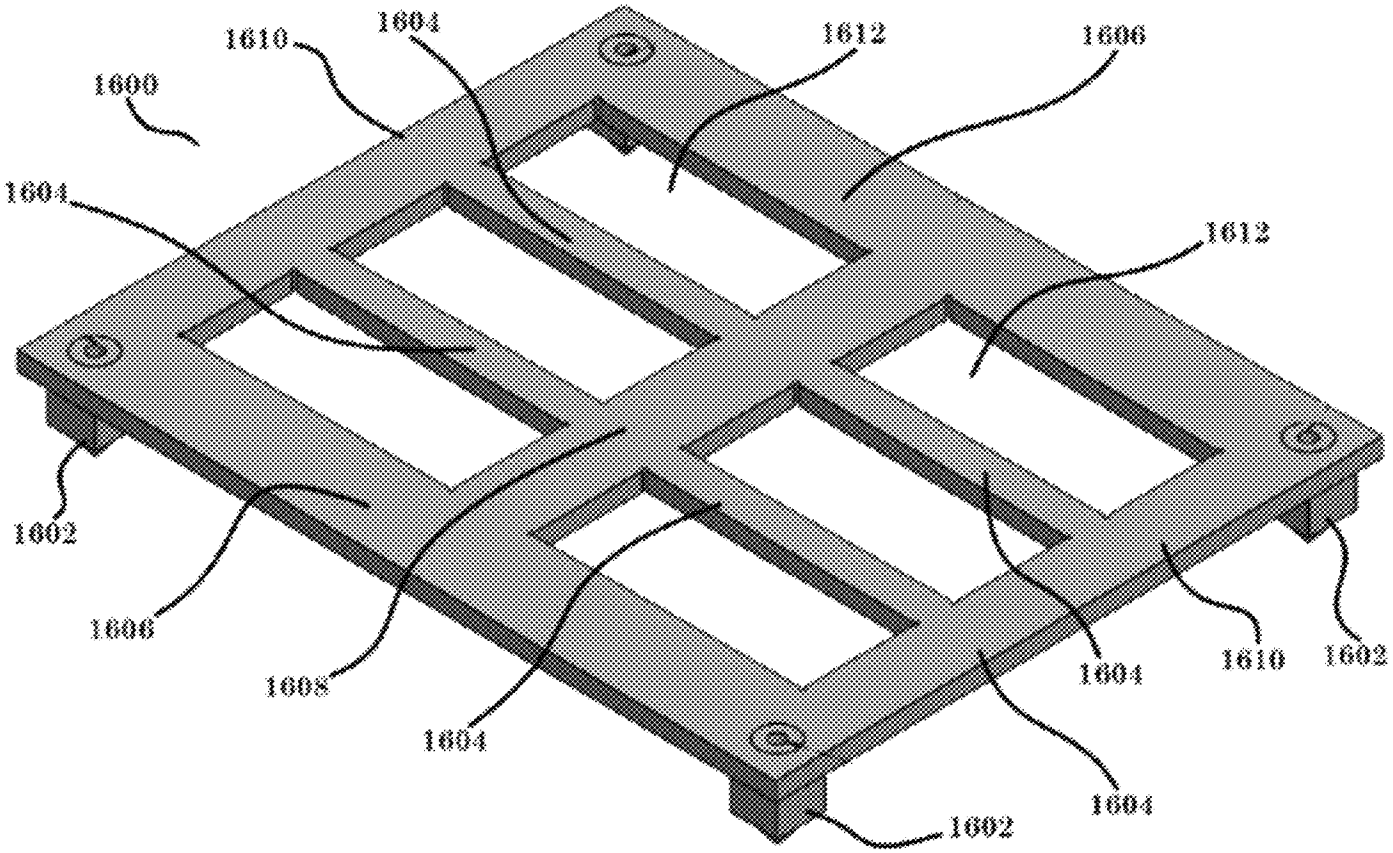
FIG. 16 shows one embodiment of a cap array of the current disclosure.
Figure 17:
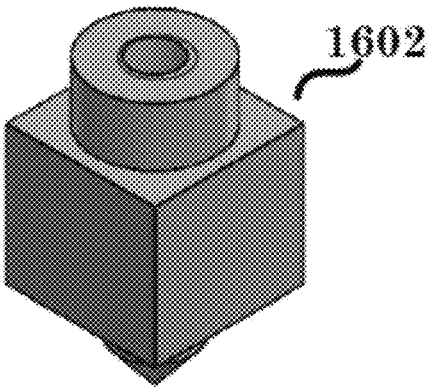
FIG. 17 shows a locating pin of the current disclosure.

FIG. 16 shows cap array 1600. Cap array 1600 may comprise locating pins 1602 and engagement bars 1604. Locating pins 1602 may be machined to precise heights to ensure that syringe caps, not shown, lie flush with the surface supporting cap array 1600. This in combination with cap array engagement bars 1604, cap array side arms 1606, cap array cross bar 1608, and cap array end bars 1610 provides frictional engagement with caps within cap array voids 1612. Thus, the caps, not shown, are secured within cap array voids 1612 and held in place via engagement bars 1604, side arms 1606, and cross bar 1608 with the cap by sizing same to hold the caps in place. Gripper assembly 1200, or a pair of grippers 1200, then move the syringe Luer lock end into engagement with a cap held within cap array 1600. Gripper assembly 1200, or paid of grippers 1200, then "twist" the syringe to secure a cap onto the Luer lock end of the syringe. Once secure, gripper assembly 1200 places the syringe in a finished spot, such as a slide, container, package, etc., to signify no further engagement with the syringe is needed and same is fully filled. While cap array 1600 is shown as rectangular with six (6) rectangular voids defined therein, the current disclosure is not so limited. Cap array 1600 may be formed to be polygonal, square, circular, or irregularly shaped, cap array voids 1612 may be the same shape or differently shaped than cap array 1600 and may include more or less than six (6) voids. FIG. 17 shows a locating pin 1602 disengaged from cap array 1600.

Figure 18:
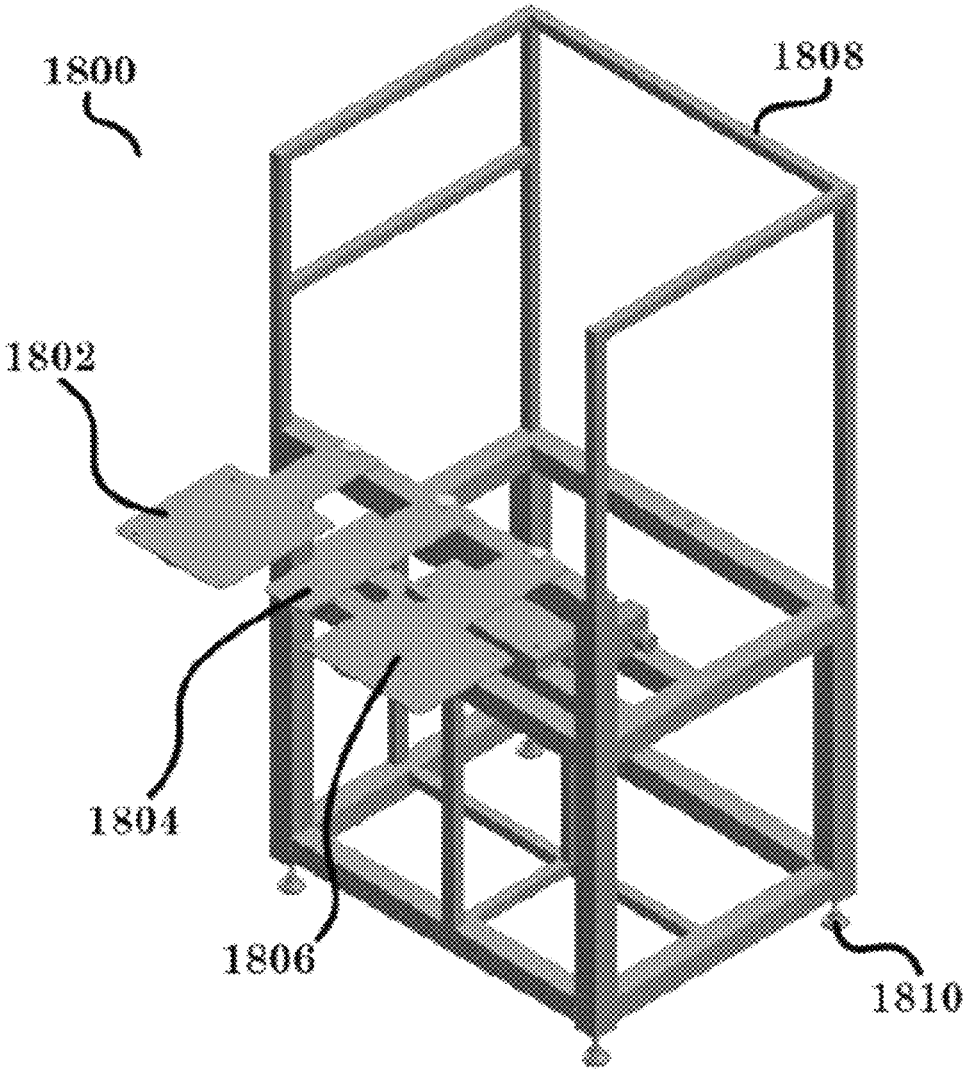
FIG. 18 shows a robot base of the current disclosure.

FIG. 18 shows a robot base 1800 that may be employed with the current disclosure. Robot base 1800 may secure a robot such as YASKAWA MOTOMAN GP8 and provide a work platform for syringe magazine 800, syringe cam 1100, filling block 1500, and cap array 1600. As FIG. 18 shows, robot base 1800 may include capping shelf 1802, filling station shelf 1804, and syringe magazine shelf 1806. Robot base frame 1808 may be shaped and sized to accommodate various sized working areas and supports added or withdrawn in order to accommodate robots or working areas of different sizes. Robot base frame adjustable feet 1810 may be used to level the robot base 1800.

Figure 19:
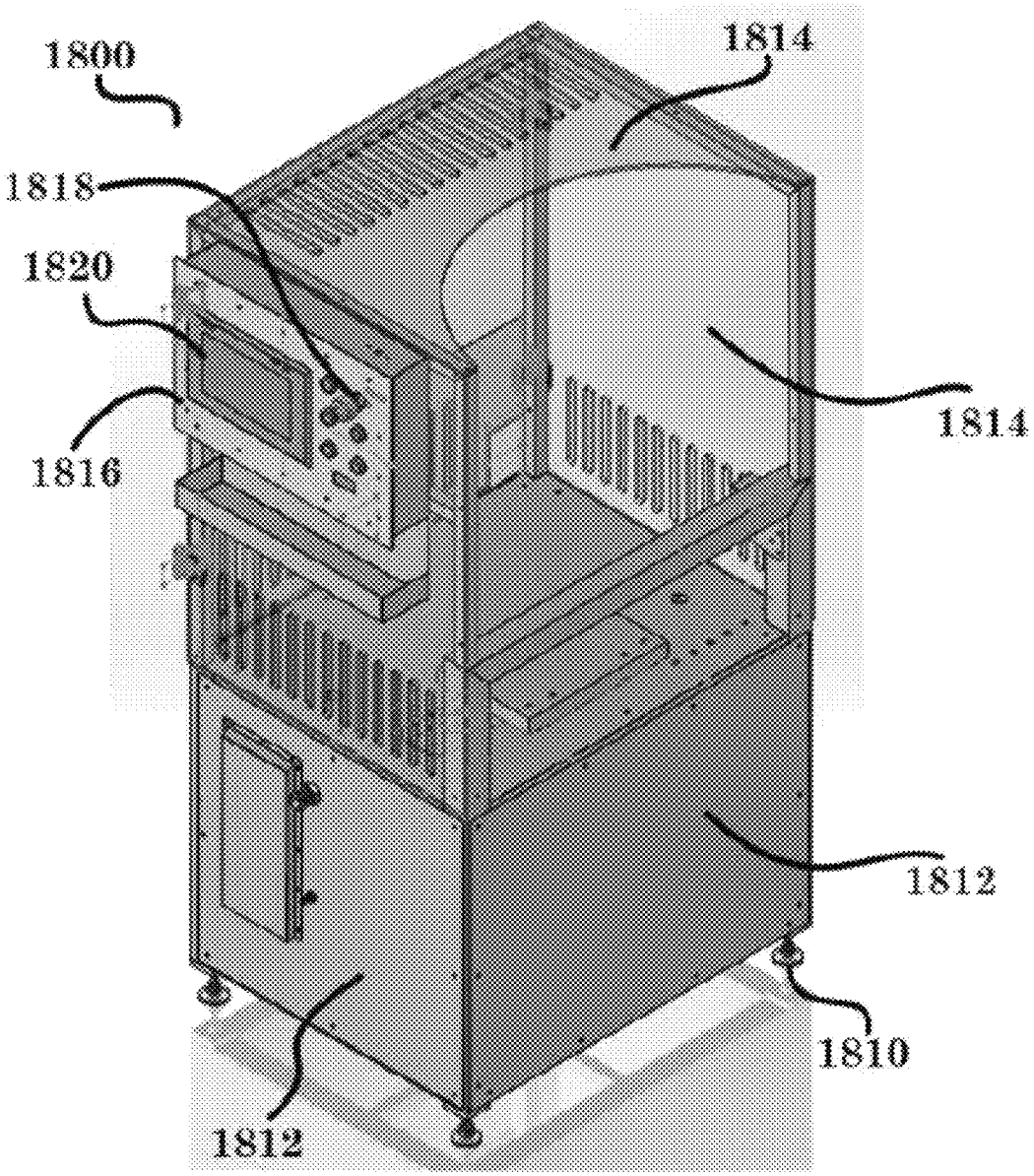
FIG. 19 shows a robot base of the current disclosure in a partially complete iteration.

FIG. 19 shows robot base 1800 with siding 1812, Plexiglas 1814, a human machine interface 1816, systems controls 1818, and monitor 1820 that allow the operator to manipulate and control the system while in use.

Figure 20:
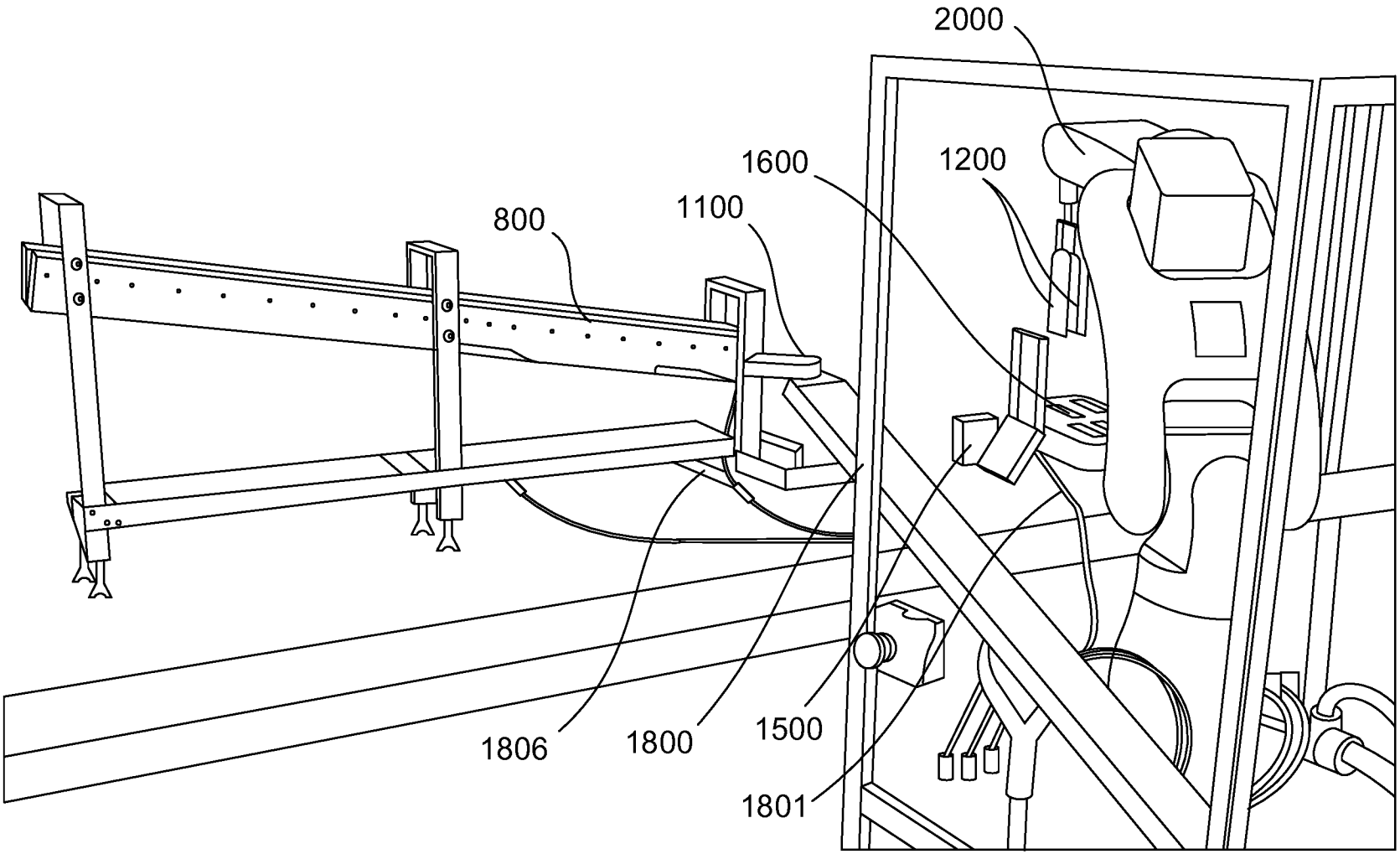
FIG. 20 shows a photograph of one embodiment of the system.

FIG. 20 shows a photograph of one embodiment of the system showing syringe magazine 800, syringe cam 1100, robot arm 2000, filling block 1500, a pair or gripper assemblies 1200, cap array 1600 and robot base 1800.

Figure 21:
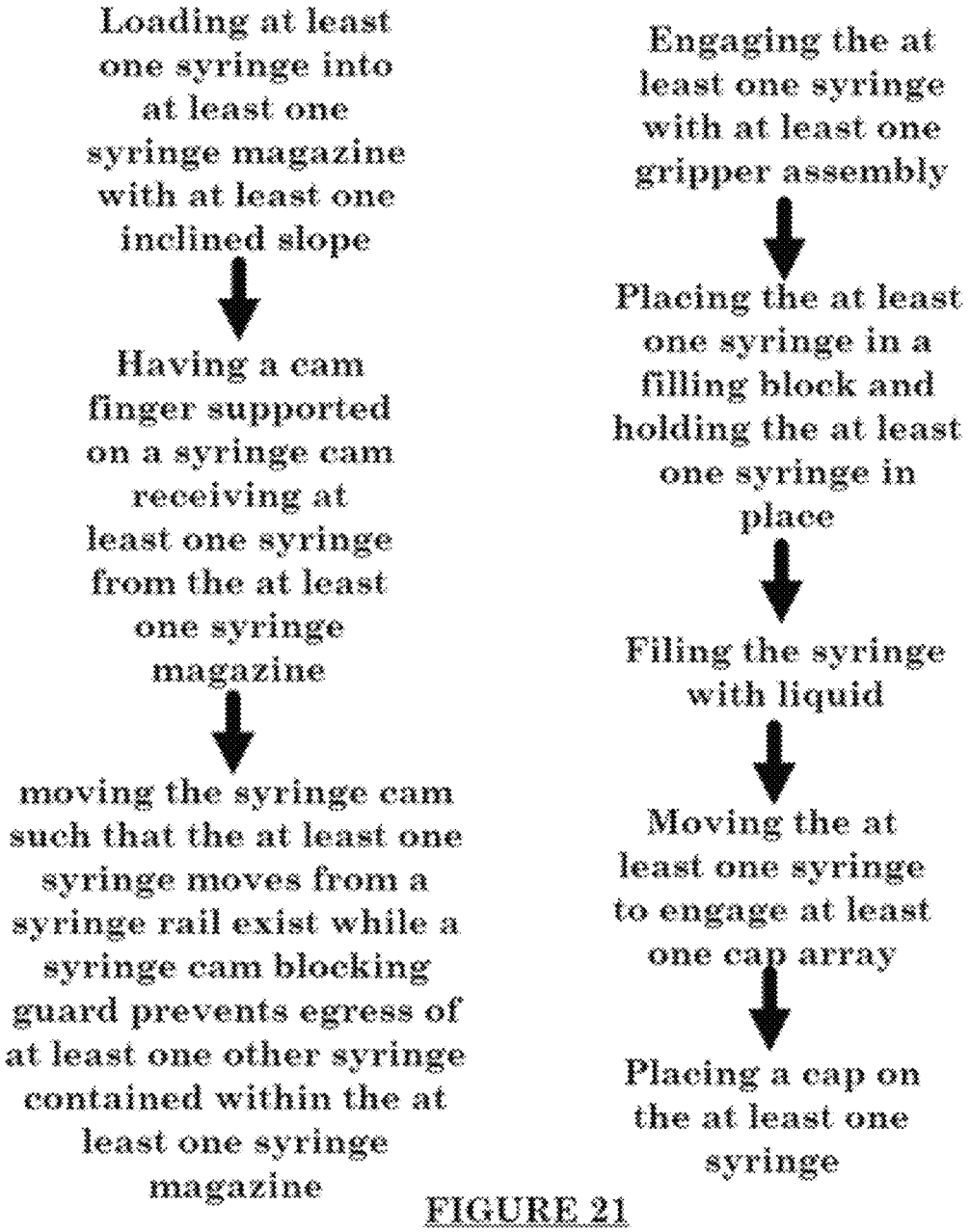
FIG. 21 shows one embodiment of a method of the current disclosure.

FIG. 21 shows one possible syringe loading method of the current disclosure.

This project is special because there is nothing like it in the public market. There is currently no system which utilizes a sterile hood in an automated manner. Doing so is advantageous because hoods are readily accessible for purchase. This greatly reduces overhead costs and allows for smaller scale parties such as hospitals. We hope that this system can make medication more affordable and accessible to hospitals and therefore patients by reducing overhead costs, and allowing small scale production of vital drugs both on and off the drug shortage list.

Various modifications and variations of the described methods, pharmaceutical compositions, and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An automatic syringe filling station comprising:

at least one syringe magazine comprising at least one inclined slope, wherein the inclined slope is configured to incline at substantially 10 degrees;

at least one syringe cam, in communication with the at least one syringe magazine, comprising a cam finger and a cam blocking guard wherein the at least one syringe cam is configured to remove at least one syringe from the at least one syringe magazine;

at least one gripper assembly for removing the at least one syringe from the at least one syringe cam after the at least one syringe cam moves the at least one syringe from the at least one syringe magazine to a selection location wherein the at least one gripper assembly engages the at least one syringe, wherein the gripper assembly comprises at least two gripper fingers configured to engage the at least one syringe and provide axial, translational and rotational constraint of the at least one syringe;

the at least one gripper finger is attached to at least one gripper body to form at least one conjoined gripper;

a coupler connecting the at least one conjoined gripper to at least one articulated armature configured to manipulate and move the at least one syringe;

at least one filling block for injecting liquid into the at least one syringe;

at least one cap array including at least one gravity fed capping dispenser with at least a first gate and a second gate configured to provide at least one cap for engagement with the at least one articulated armature and to place the at least one cap on the at least one syringe; and all of the above contained in an enclosure configured to have at least one removable panel configured to allow access to an interior of the enclosure.

2. The automatic syringe filling station of claim 1, wherein the at least one syringe cam is pneumatically powered.

3. The automatic syringe filling station of claim 1, wherein the at least one syringe is oriented within the at least one syringe magazine and at least one syringe cam with a Luer lock of the at least one syringe oriented downward.

4. The automatic syringe filling station of claim 1, wherein the at least one syringe cam is biased to return to engage at least one other syringe contained in the at least one syringe magazine.

5. The automatic syringe filling station of claim 1, wherein the cam blocking guard prevents release of at least one other syringe as the at least one syringe is moved.

6. The automatic syringe filling station of claim 1, wherein the at least one gripper assembly can be disassembled to replace portions of the at least one gripper assembly.

7. The automatic syringe filling station of claim 1, wherein the cap array defines voids that engage at least one syringe cap.

8. The automatic syringe filling station of claim 1, wherein the filling block has at least one face of the filling block aerodynamically shaped to improve air flow.

9. A method for automatically filling a syringe comprising:

loading at least one syringe into at least one syringe magazine comprising at least one inclined slope, wherein the inclined slope is configured to incline at substantially 10 degrees;

having a cam finger supported on a syringe cam, in communication with the at least one syringe magazine, receiving at least one syringe from the at least one syringe magazine, wherein the syringe cam is configured to remove at least one syringe from the at least one syringe magazine;

moving the syringe cam such that the at least one syringe moves from a syringe rail exit while a syringe cam blocking guard prevents egress of at least one other syringe contained within the at least one syringe magazine;

engaging the at least one syringe with at least one gripper assembly after the syringe cam moves the at least one syringe from the at least one syringe magazine to a selection location wherein the at least one gripper assembly engages the at least one syringe, wherein the gripper assembly comprises at least two gripper fingers configured to engage the at least one syringe and provide axial, translational and rotational constraint of the at least one syringe;

the at least one gripper finger is attached to at least one gripper body to form at least one conjoined gripper;

a coupler connecting the at least one conjoined gripper to at least one articulated armature configured to manipulate and move the at least one syringe;

placing the at least one syringe in a filling block and holding the at least one syringe in place;

filling the at least one syringe with liquid;

moving the at least one syringe to engage at least one cap array including at least one gravity fed capping dispenser with at least a first gate and a second gate configured to provide at least one cap for engagement with the at least one articulated armature and to place the at least one cap on the at least one syringe; and placing a cap on the at least one syringe.

10. The method of claim 9, wherein the at least one syringe is oriented within the at least one syringe magazine and syringe cam with a Luer lock of the at least syringe oriented downward.

11. The method of claim 9, comprising biasing the at least one syringe cam to return to engage the at least one other syringe contained in the at least one syringe magazine.

12. The method of claim 9, further comprising disassembling the at least one gripper assembly to replace portions of the at least one gripper assembly.

13. The method of claim 9, further comprising securing syringe caps via a cap array.

14. The method of claim 9, further comprising aerodynamically shaping the filling block to promote air flow around the filling block.

15. The method of claim 9, further comprising pneumatically powering the at least one syringe cam.

* * * * *